US006083292A

United States Patent [19]

Fumagalli

[11] Patent Number: 6,083,292

[45] Date of Patent: Jul. 4, 2000

[54] DOMESTIC VACUUM CLEANER WITH AXIAL CYCLONE

[75] Inventor: Silvano Fumagalli, Milan, Italy

[73] Assignee: Canoy S.p.A., Milan, Italy

[21] Appl. No.: 09/096,896

[22] Filed: Jun. 12, 1998

[51] Int. Cl.[7] ..... B01D 45/12

[52] U.S. Cl. ..... 55/345; 55/318; 55/337; 55/342; 55/344; 55/348; 55/456; 55/459.1; 55/DIG. 3

[58] Field of Search ..... 55/342, 344, 345, 55/348, 331, 337, 459.1, 459.4, DIG. 3, 318, 326, 456, 458, DIG. 8

[56] References Cited

U.S. PATENT DOCUMENTS

| | | | |
|---|---|---|---|
| 1,420,665 | 6/1922 | Newcombe | 55/DIG. 3 |
| 2,943,698 | 7/1960 | Bishop | 55/DIG. 3 |
| 3,425,192 | 2/1969 | Davis . | |
| 3,925,045 | 12/1975 | Cheng | 55/345 |
| 4,289,611 | 9/1981 | Brockmann | 55/248 |
| 4,569,687 | 2/1986 | Feng | 55/345 |
| 4,746,340 | 5/1988 | Durre et al. | 55/348 |
| 4,971,603 | 11/1990 | Prinsloo et al. | 55/345 |
| 5,690,709 | 11/1997 | Barnes | 55/348 |

FOREIGN PATENT DOCUMENTS

| | | |
|---|---|---|
| 0 018 197 A1 | 10/1980 | European Pat. Off. . |
| 0 042 732 A2 | 12/1981 | European Pat. Off. . |
| 0 489 565 A1 | 6/1992 | European Pat. Off. . |
| 0 728 435 A1 | 8/1996 | European Pat. Off. . |

*Primary Examiner*—David A. Simmons
*Assistant Examiner*—Minh-Chau T. Pham
*Attorney, Agent, or Firm*—Lieberman & Nowak, LLP

[57] ABSTRACT

Domestic vacuum cleaner with multiple cyclones arranged in cascade, in which a first tangential cyclone supplied with a flow of dust-laden air captures the coarser particles in a first container arranged below said first cyclone and discharges the air flow, partially purified, into a first internal duct coaxial with the first cyclone and housing an axial swirling device which concentrates the residual particles in a peripheral fraction of the flow, which is conveyed by a capturing ring into a second tangential cyclone, while the residual fraction of flow passes through the ring and is conveyed by a second duct, axially aligned with the first duct, to a suction unit.

The captured fraction of flow conveyed into the second cyclone deposits the residual particles in a second container arranged below the second cyclone and thus purified is sucked into the second duct by the fraction of flow passing through the ring, which acts as an extractor nozzle.

9 Claims, 4 Drawing Sheets

DOMESTIC VACUUM CLEANER WITH AXIAL CYCLONE

The present invention relates to a domestic vacuum cleaner with a swirling device or axial cyclone.

BACKGROUND OF THE INVENTION

It is known that vacuum cleaners are used for household cleaning, in which the dusty air flow drawn in by a motor/suction unit passes through a dust-collecting filter bag and is purified by the latter.

The periodic replacement of the filter, necessary if the vacuum cleaner is to be able to function well (vacuum cleaners in which the filter must be periodically cleaned are now obsolete) and having to be carried out as frequently as possible in order to ensure a high level of efficiency, is a serious inconvenience for the user because handling the dirty filter during its removal and replacement results in the generation of dust.

A further drawback of these vacuum cleaners is the power consumption which increases the greater the degree of filtering required and the ability to capture finer dust particles, because the filter bag constitutes an obstacle for the air flow and causes significant head losses which increase in accordance with the increase in the accumulation of dust in the bag and clogging of the latter.

In order to achieve a higher and more constant level of efficiency as well as a greater capacity for capturing the dust, including the finest sort, which is very often the cause of allergies, cyclone-type domestic vacuum cleaners have also been proposed and introduced onto the market, in which the separation of a considerable fraction of the dust and particles of larger size and greater density is achieved, by means of the centrifugal effect, with very little loss of head, inside a tangential cyclone, while a filter arranged downstream of the cyclone is assigned the task of capturing the finest particles.

The larger-sized solid particles are accumulated in a receptacle which may be periodically emptied.

As a further step, vacuum cleaners with two tangential cyclones in a cascade arrangement have also been proposed, the first cyclone having the function of capturing the larger-sized particles, and the second the function of performing further filtering.

Examples of this solution are given in EP-A-0018197, EP-A-0489565 and EP-A-0042723.

A drawback with twin-cyclone vacuum cleaners is their large size which, in order to be reduced, generally requires that the two cyclones be arranged coaxially and, to a certain degree, inside one another.

This has the consequence that the air flow follows a winding path, with many reversals and changes in direction which result in significant head losses and require the use of a powerful motor/suction unit in order to generate a suitable air flow rate in the vacuum cleaner.

Thus, the advantage arising from the low head losses in the cyclones is lost on account of the high head losses in the ducts connecting cyclones and motor/suction unit.

The reduction in dimensions achieved is, however, of a limited nature and not sufficient to satisfy the user's demands.

There are, in fact, technical limitations which prevent reduction of the dimensions beyond a certain limit.

In cyclones, separation of the dust is caused by the combined effect of several factors:

A considerable speed must be imparted to the air flow which is introduced tangentially into a cyclone so that the centrifugal effect results in efficient separation of the solid particles, which are concentrated at the periphery of the cyclone in the vicinity of the walls.

Moreover, in the cyclone, the speed of the air flow must be reduced considerably so that the centrifugal effect and the friction exerted by the walls on the particles are able to prevail over the conveying action exerted by the air flow which increases in proportion with speed.

It is therefore obvious that, in relation to the flow rate of sucked-in air, the dimensions of the cyclones cannot be less than a certain limit, even though, from a theoretical point of view, it would be desirable to use cyclones with as small a diameter as possible, because this increases the separation efficiency (the centrifugal acceleration is defined by $V^2/R$ where V is the tangential speed and R the radius of curvature imparted to the flow).

The particles which gradually accumulate on the walls of the cyclone, owing to the action of the force of gravity, then tend to travel towards the bottom part of the cyclone where they may be collected in a suitable storage receptacle which must be periodically emptied.

This involves a further functional limitation: the cyclones must operate with the axis of the cyclone, i.e. the axis of the frustoconical or cylindrical element which forms the cyclone, arranged vertically or nearly vertically, the flow being introduced tangentially at the top thereof, extraction of the purified air along the axis of the cyclone, far from its base, and collection of the dust at the base of the cyclone.

This limitation has serious consequences from a structural point of view when several cyclones are to be arranged in cascade. Thus the flow of sucked-in air emerging from the top of the second cyclone must in fact be conveyed towards a motor/suction unit which, owing to static phenomena and often also for functional reasons (often it must also operate the rotating brushes), is generally located beneath the cyclones, in a foot section equipped with wheels for travelling on the ground.

For this purpose, either an annular duct which surrounds the cyclones, or a connecting tube, is used.

However, both solutions reduce the amount of space available for the particle-capturing cyclones and for the storage receptacles, increasing the overall dimensions of the assembly and reducing the available storage capacity which, however, is essential for ensuring correct operation of the vacuum cleaner even when the latter is arranged in an inclined position.

SUMMARY OF THE INVENTION

The present invention overcomes these problems and provides a high-efficiency vacuum cleaner which has a very low power consumption, compact dimensions and a high capacity for accumulation of the particles.

The concept forming the basis of the present invention is to use a first tangential cyclone as a component for separating the larger-size particles and to convey the outgoing flow from the first cyclone into a swirling device or axial cyclone, the duct of which inside or coaxial with the first cyclone also forms the duct for connection to a motor/suction unit arranged at the bottom.

The function of the swirling device or axial cyclone is that of imparting to the sucked-in flow a swirling movement which, owing to the centrifugal effect, concentrates the residual solid particles in a peripheral annular flow band.

This peripheral annular flow band, corresponding in terms of flow rate, roughly speaking, to an amount of no more than 20% of the total flow and being, by way of indication, of the order of 6/10%, can be captured by a capturing or centrifuging ring and conveyed into a cyclone of the tangential type which, since it has to purify a reduced fraction of the flow, may have extremely small dimensions, therefore leaving ample space for the storage receptacles and improving its efficiency, while the main portion of the flow may flow on directly, without encountering obstacles, towards the motor/suction unit.

The greater space available for the storage receptacles increases the storage capacity, while reducing the frequency of the emptying operations and/or allowing improved operability even in conditions where the vacuum cleaner is used with the axis of the cyclones somewhat inclined with respect to the vertical.

With this approach the head losses of the sucked-in air flow and hence the power necessary for generating the flow are reduced to a minimum.

Moreover, the solution proposed lends itself to numerous constructional variants which envisage the collection of the coarser and finer particles in separate containers for independent emptying, in containers which can be combined for joint emptying and also collection of the finer particles or all the particles in a sealable capsule.

In the case of separate storage, the capsule may be sealed without the need for opening the vacuum cleaner such that the risk of any dispersion of dust is eliminated.

BRIEF DESCRIPTION OF THE DRAWINGS

The characteristic features and advantages of the invention will emerge more clearly from the description which follows of a preferred embodiment and its variants, provided by way of a non-limiting example with reference to the accompanying drawings in which.

DETAILED DESCRIPTION OF THE PREFERRED EMBODIMENT

Figure 1:
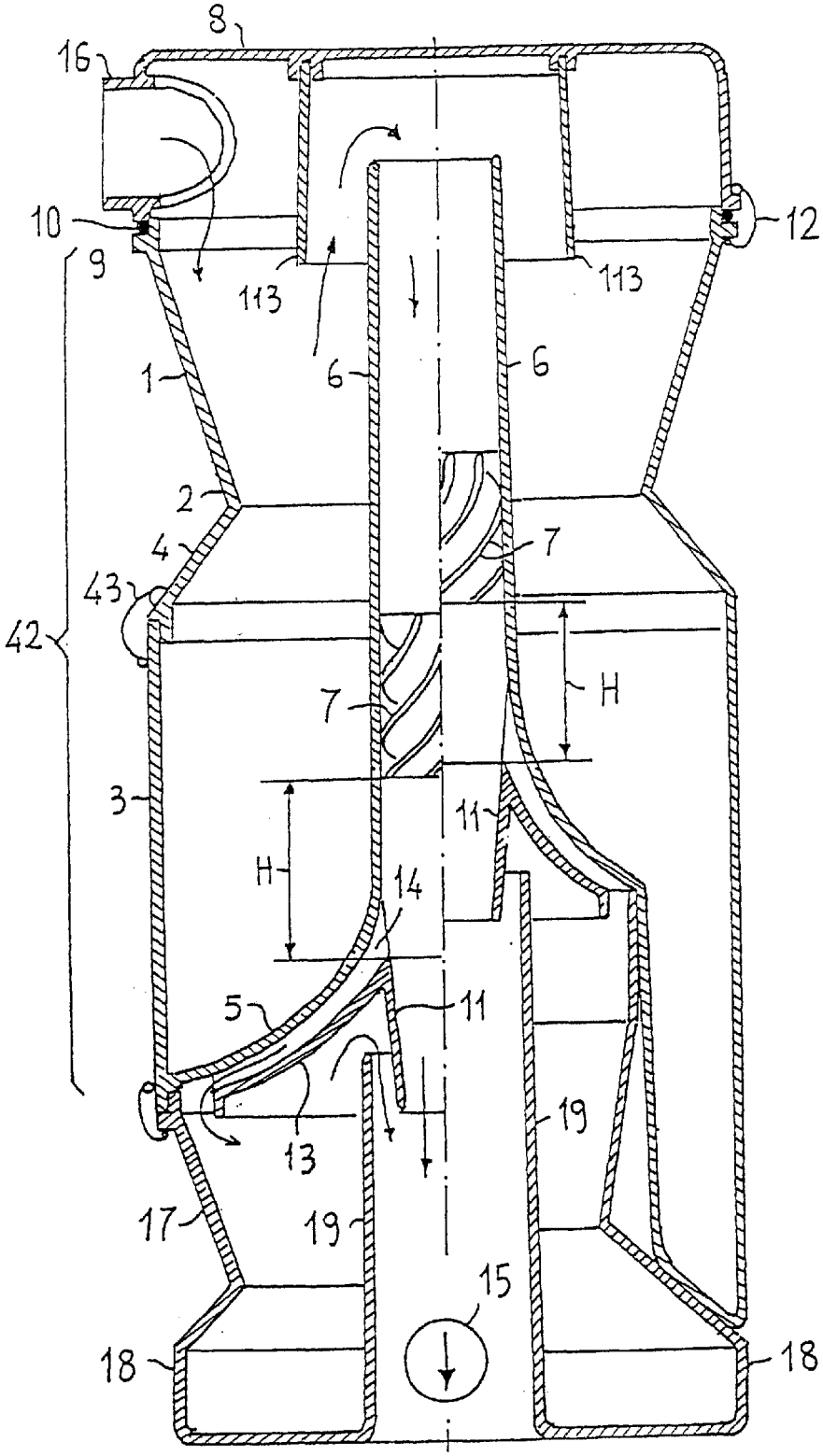
FIG. 1 shows a diametral half-sectional view of a preferred embodiment of the vacuum cleaner in accordance with the present invention, with a first constructional variant shown in the left-hand half-section and a second constructional variant shown in the right-hand half-section.

With reference to FIG. 1, a twin-cyclone vacuum cleaner, with axial cyclone according to the present invention, essentially comprises a first hollow frustoconical body 1 with a smaller-diameter bottom end 2 which is connected to a generally cylindrical container 3 with a converging collar 4.

Coaxially with respect to the container 3 and the frustoconical body 1 and inside these there extends a generally cylindrical duct 6 (which is in fact slightly conical in order to facilitate the operation of mould-stripping) connected via a diffuser section 5 to the container 3, closing it at the bottom.

The frustoconical body 1, container 3, diffuser or base 5 and duct 6 may be easily made from plastic by means of blow-moulding, as a single piece, collectively referred to below as the upper element 42.

Alternatively the frustoconical body 1 may be separable from the container 3 and removably connected to the latter by means of fastening means 43, conventional per se.

The hollow frustoconical body 1 is closed at the top by a cover-piece 8, generally in the form of an inverted cylindrical bowl, which is also obtained by means of moulding a plastic material and is connected to the suitably shaped upper lip 9 of the frustoconical body 1, with an intervening seal 10.

The removable connection between cover-piece 8 and upper element 42 is ensured by suitable fastening means 12, of conventional type, as shown on the right-hand side of FIG. 1.

Alternatively, if the frustoconical body 1 is separable from the container 3, the cover-piece 8 may be integral with the frustoconical body 1.

The cover-piece 8 has fixed inside it, by means of fusion bonding, adhesive bonding or even simply by means of pressure, a generally cylindrical element 113 which extends into the frustoconical body 1.

The cover-piece 8 is provided with an inlet opening 16 for the tangential introduction of air into the annular space formed between body 1 and element 113.

The air sucked in by the motor/suction unit 15 enters tangentially into the cover-piece 8, descends with a swirling movement inside the frustoconical body 1, deposits the coarser particles in the container 3 and rises back up the centre of the frustoconical body 1 so as to flow out into the central duct 6.

The inside of the duct 6 has housed inside it, fixed by means of plastic fusion bonding, adhesive bonding or even simply by means of pressure, a volute or swirling device 7, preferably with a decreasing variable pitch, for reducing as far as possible the turbulence, which imparts to the essentially axial air flow in the duct 6 a swirling movement.

Owing to the effect of this swirling movement, the residual dust contained in the air flow is concentrated, by the centrifugal effect, in a peripheral ring.

The duct 6, downstream of the swirling device 7, has housed inside it a capturing ring 11 which separates the annular portion of the air flow, from the central portion, which flows out freely through the capturing ring 11.

The capturing ring is provided externally with a diverging funnel-shaped deflector 13, adjacent to and outside the base 5, and forms together with the latter a narrow interspace for passage of the captured portion of the air flow, which retains its speed, albeit in a modified direction.

Advantageously the deflector 13 is provided with helical ribs 14 for forming in the interspace helical ducts which impart to the captured portion of the air flow a tangential velocity component.

Figure 2:
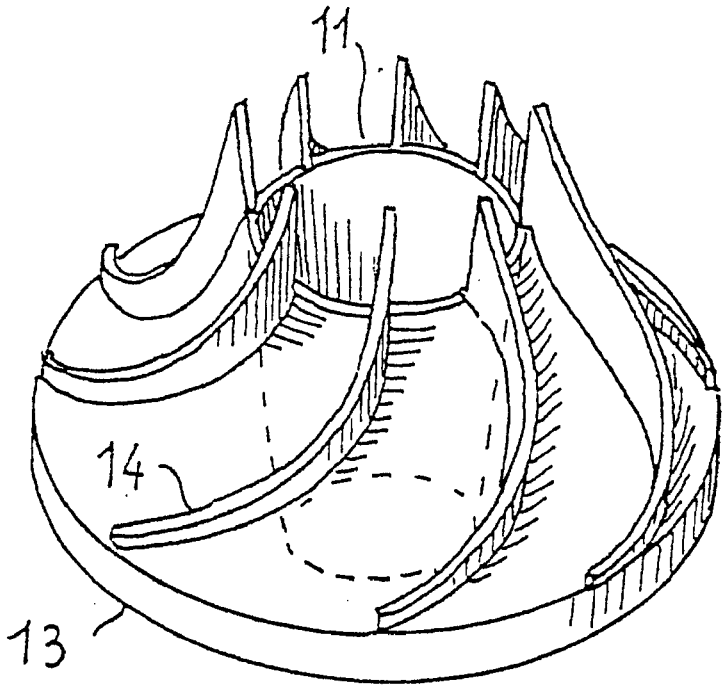
FIG. 2 shows a perspective view of a constructional part of the vacuum cleaner according to FIG. 1.

The capturing ring 11, advantageously obtained by means of the moulding of plastic material, together with the deflector 13 and the ribs 14, is shown, for the sake of greater clarity, in the perspective view of FIG. 2.

The diameter adopted for the ring 11, in relation to the internal diameter of the duct 6, is such as to capture a smaller fraction, of the order of 10% of the air flow.

For example, by way of an indication, if the internal diameter of the duct 6 is 40 mm, the diameter of the ring may be of the order of 38 mm.

The capturing ring may be permanently fixed to the base 5 of the container 3 by means of adhesive bonding or fusion bonding of the ribs, or in a removable manner by screwing it onto the duct, which is advantageously threaded for this purpose, together with the edge of the ribs.

For the maximum capturing efficiency the swirling device 7 is arranged in the duct 6, upstream of the capturing ring, at a distance H approximately equal to or slightly less than the diameter of the duct 6.

This, it should be appreciated, is because a certain period of time is needed in order for the solid particles to be concentrated at the periphery of the flow and, at the same time, on leaving the swirling device 7, the swirling flow tends gradually to resume an axial direction such that the centrifugal effect is eliminated.

Although a theoretical treatment of the phenomena involved is possible, in order to determine the optimum distance H, it is preferably defined, in relation to the air flow rate in the duct, by experimental means.

The flow of dust-laden air captured by the ring 11 obviously must not be discharged into the environment.

For this purpose, below the container 3 and the base 5 there is arranged a second frustoconical body 17 which is removably and sealingly joined to the bottom peripheral end of the container 3 (to which it is fastened by known means) and extends at the bottom into a bell part 18 for collecting the finer particles.

The bell part 18 is provided internally with an axial duct 19 aligned with the duct 6 and having a diameter equal to or slightly greater than that of the duct 6 and extending almost as far as the deflector 13, so as to leave a through-aperture of suitable width.

The flow portion captured by the ring 11 emerges via the interspace formed between the base 5 and deflector 13 so as to enter tangentially into the frustoconical body 17, which acts like a tangential cyclone for the captured flow fraction. In the cyclone the air flow reduces its speed considerably, such that the finer particles is deposited on the walls and falls into the bell part 18.

The perfectly purified air rises back up centrally and flows out into the duct 19 through the free aperture formed between the funnel 13 and the duct 19.

Suction of air from the tangential cyclone formed by the body 17 is caused by the main flow which flows through the ring 11 and is then conveyed into the duct 19.

The ring 11 functions in the manner of an extractor nozzle.

In order to increase its extraction efficiency, the ring 11 may be advantageously shaped as a converging tube section, such that at the outlet of the ring the flow speed is greater than the speed at the inlet and the pressure is correspondingly lower.

The total flow is then conveyed by the duct 19, if necessary via suitable connections, to the motor/suction unit 15 so as to be released into the atmosphere perfectly purified, without the need for further filtration systems.

In order to remove the particles collected in the chamber 3 and in the bell part 18, it is sufficient to separate the frustoconical body 17 from the container 3 and the latter from the collar 4 (or if necessary from the cover-piece 8) and pour the respective contents into a refuse collector.

The version described is susceptible of many variants.

The right-hand side of FIG. 1 shows, for example, a diametral half-sectional view of an embodiment in which the container 3 for collecting the coarser particles extends downwards so as to embrace internally a frustoconical body 17 with a maximum diameter less than that of the container 3.

If necessary the bell part 18 may also be embraced by the container 3.

In this case the tangential cyclone formed by the frustoconical body 17 may be designed with a maximum diameter much smaller than the diameter of the container 3 so as to achieve the maximum capturing efficiency in relation to the flow rate of the captured fraction of air flow and independently of the diameter of the container 3.

The space thus made available is advantageously used for the formation of a receptacle for collecting the coarser particles of greater volume, which extends much further downwards, such that the functioning of the vacuum cleaner is improved in conditions of use where the axis of the cyclones is somewhat displaced from the vertical.

Since the other aspects are identical to the version already described (left-hand side of FIG. 1) and identified in FIG. 1 by the same reference numbers, any further description is not necessary.

Figure 3:
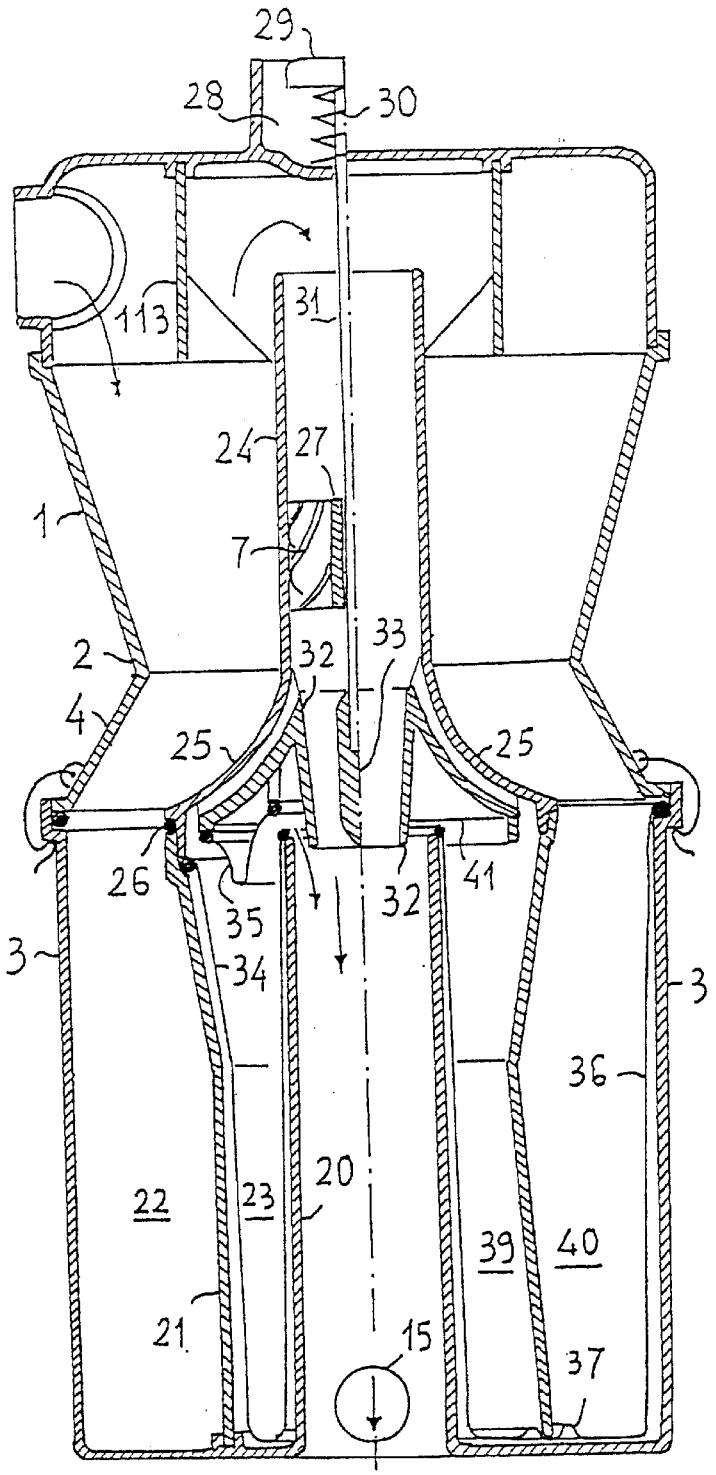
FIG. 3 shows partially, in a diametral half-sectional view, in the left-hand half-section and in the right-hand half-section, respectively, a third and fourth constructional variant of the vacuum cleaner according to FIG. 1, modified for use with a replaceable and disposable capsule for collecting and containing the dust, and the associated sealable capsule.

A third variant is shown in the left-hand side of FIG. 3.

It is known that the emptying of the dust storage receptacle in vacuum cleaners is a troublesome operation for the user, owing to the risk of dust dispersion, which it is desirable to avoid.

For this purpose, in FIG. 3, on the left-hand side, the bottom end 2 of the frustoconical body 1 is removably and sealingly joined by means of a collar 4, to the cylindrical container 3.

The latter is provided with a coaxial duct 20 which extends inside the container 3 and, operationally speaking, corresponds to the duct 19 of FIG. 1.

Inside the container 3 and fixed thereto (by means of adhesive bonding, plastic fusion bonding or engagement of one end) there is arranged a generally frustoconical element 21 which separates the internal volume of the container into two chambers 22, 23 for separate collection of the coarser particles and finer dust, respectively.

The frustoconical body 1 is closed at the top by the cover-piece 8, provided with a tangential inlet opening 16 for sucked-in air and a coaxial duct 24, operationally equivalent to the duct 6 in FIG. 1.

The duct 24 is provided at the top with radial fins 25 fixing it to the cover-piece 8 and to the cylindrical element 113, at a suitable distance therefrom, so as to allow the sucked-in air to pass from inside the cyclone formed by the frustoconical body 1, into the duct 24.

The duct 24 terminates at the bottom in a funnel-shaped diffuser 25, the edge of which is joined in a sealing manner, if necessary ensured by an O-ring 26, to the upper edge of the frustoconical element 21.

The duct 24 has fixed inside it, as in the versions already described with reference to FIG. 1, a swirling device 7 provided with an axial sleeve 27.

The cover-piece 8 is provided externally with a seating 28, for a push knob 29, which is supported in a rest position by a compression spring 30 and joined to an actuating rod 31 freely passing through the cover-piece 8 and through the sleeve 27 and axially extending as far as the bottom end of the duct 24.

At the bottom end of the stem 31 there is fixed a capturing ring 32 which differs from that of FIG. 2, already described, only owing to the presence of internal radial fins and an axial core 33 for attaching it to the rod 31.

By operating the knob 29 it is therefore possible to cause axial displacement of the capturing ring so as to move it away from the diverging element 25.

The chamber 23 has removably housed inside it a toroidal and generally conical capsule 34 which is open at the top and provided with two lips for joining with an annular cap 35 inserted, with slight forcing, onto the capturing ring 32 outside the latter and at the bottom of the flared deflector 36 of the capturing ring.

When the capturing ring 32 is in the rest position, namely when the knob is not actuated, the flow portion of air captured by the ring 32 is able to flow into the tangential cyclone formed by the capsule 34 and then flow out into the duct 20.

When the knob 29 is operated, the capturing ring 32 pushes downwards the annular cap 35 which is irreversibly joined to the capsule 34, sealing it.

Separation of the cover-piece 8 (together with the duct 24, diffuser 25 and capturing ring 32) and the frustoconical body 1 from the container 3 then allows extraction of the sealed capsule 34 from the chamber 23 without any dust generation, and the chamber 22 of the coarser particles, which inherently does not generate dust, can be emptied.

Alternatively cap 35 and external profile of the ring 32 may be shaped so that the sealing action of the capsule results in greater forcing of the cap 35 (or the capsule 34) onto the ring 32, such that removal of the frustoconical body 1 (and/or cover-piece 8) results in removal and extraction of the sealed capsule 34 from the chamber 23.

The capsule may then be separated from the ring 32 and removed with a manual action performed by the user.

It is also possible for the cap 35 to be screwed onto the ring 32 and for the capsule 34, once it has been sealed by the cap and fixed to the latter, to be removed by means of unscrewing.

The right-hand side of FIG. 3 shows a fourth variant.

In this variant, the chamber 3 houses a toroidal capsule 36 with a ribbed base 37, so as to sealingly engage with an annular element 38, generally frustoconical or cylindrical, fixed to the funnel-shaped diffuser 25 (for example by means of a screw connection) and extending as far as the bottom of the container 3, so as to form, in the capsule 36, two separate and coaxial chambers 39, 40 for collecting the finer dust and coarser particles, respectively.

With separation of the frustoconical body 1 from the container 3, the element 38 is extracted from the capsule and the capsule may be closed manually and sealed with an annular cap, not shown, then extracted from the container 3 and thrown away in total safety, without the risk of dispersion of dust.

Clearly in this case no mechanical closing device which can be operated from the outside of the vacuum cleaner is provided.

Figure 4:
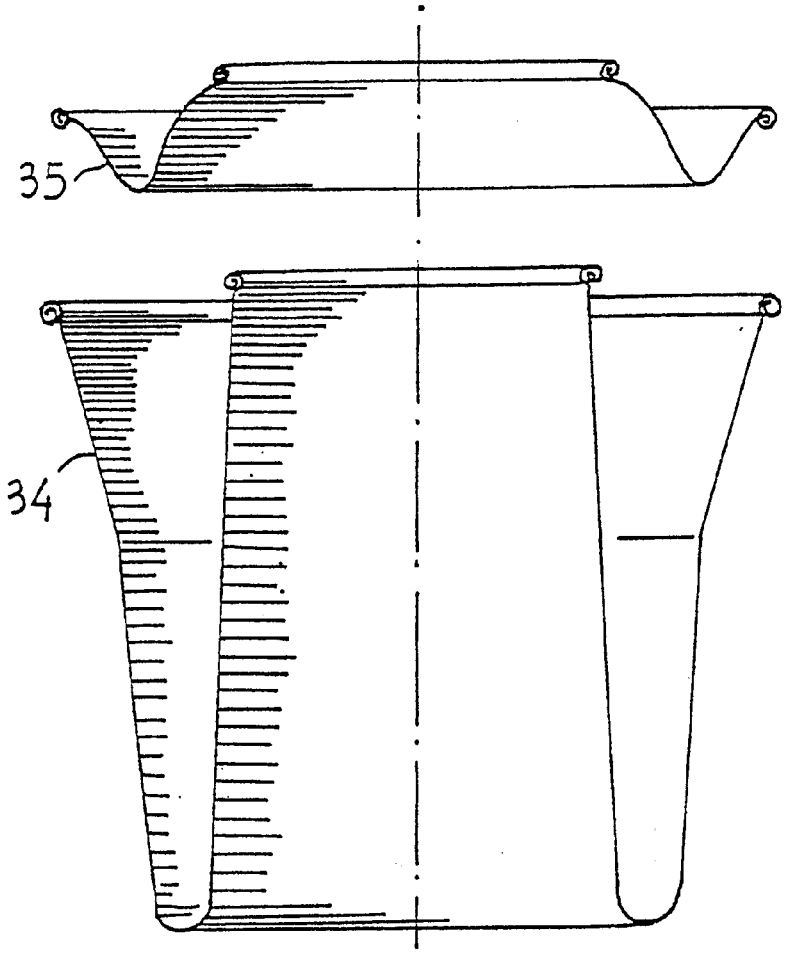
FIG. 4 shows a diametral section through a sealable capsule for the vacuum cleaner shown in the left-hand half-section of FIG. 3.

FIG. 4 shows, for greater clarity, a cross-sectional view of the capsule 34 and the associated cap 35 according to the left-hand half-section of FIG. 3.

The structure of the capsule 36 according to FIG. 3 (right-hand half-section) and associated cap is entirely similar.

These consumables must necessarily be low-cost and must have a shape which allows a stock of consumable parts to be stored in a very small space.

The capsule and the associated cap may be manufactured at a low cost from plastic material shaped by means of blow-moulding, with a very small thickness, as in the case of ordinary plastic (or waterproof paper) cups used in automatic drink dispensers.

The edges of the capsule and the associated cap may be reinforced and rounded by rolling them up on themselves in a known manner.

The cap 35 is conveniently shaped in the manner of an overturned volcanic cone so that the (downward) rim of the crater forms a separating screen between the air entering the cyclone formed by the element 21 (FIG. 3) and the outgoing flow.

This shape also allows a plurality of caps to be stacked on top of one another in a very small amount of space.

So that the user may keep a stock of capsules which does not take up too much space, the capsules are obviously formed with walls having a conicity such that several capsules may be inserted one inside the other.

As an alternative to the toroidal capsule 36 of FIG. 3, right-hand side, it is also possible to use a plastic bag with a central tube which is fitted onto the axial duct 20 and the end of which is folded down over the top of the duct 20 where it is fixed by suitable radial ribs of the ring 32. The peripheral edge of the bag, in turn, may be folded down over the upper lip of the container 3 and fixed there by the collar 4.

Central tube and edge of the bag may be clamped together by a fastener for hermetic sealing of the bag and removal thereof.

Although the above description refers to a vacuum cleaner with a first high-efficiency (frustoconical) tangential cyclone, followed, in a cascade arrangement, by a swirling device or second axial cyclone and, for the fraction of flow captured by the capturing ring, also by a third high-efficiency tangential cyclone, there is no reason why either one or both of the tangential cyclones should not be formed as so-called low-efficiency cylindrical cyclones.

In fact, a high efficiency is not required for the capturing of the coarser particles and the smaller size which the tangential cyclone capturing the finer particles may have easily compensates for the reduction in efficiency resulting from the use of a cylindrical rather than a conical shape.

For the same reason, it is not necessary that the cyclone formed by the frustoconical (or cylindrical) body 1 should have, transversely with respect to its axis, a strictly circular shape.

It may also have an elliptical cross-section, in order to reconcile the flow requirements with predefined dimensional limitations.

In particular the same principle is valid for the container collecting the coarser particles, such as the container 3 in FIG. 1, which may have an elliptical or even rectangular or square cross-section, suitably joined on to the conical form of the cyclone, in order to increase the capacity within the limits imposed by a volume predefined in two directions perpendicular to one another and perpendicular to the axis of the cyclones.

I claim:

1. An improved vacuum cleaner of the type containing multiple cyclones arranged in cascade, and in which a first tangential cyclone having a top portion with an outlet separates some particles from an air flow and deposits said some particles into a first container for collecting particles, said first container arranged below said first cyclone, wherein the improvement comprises:

a diffuser;

a first internal duct coaxial with said first tangential cyclone, said first internal duct having a top communicating with the outlet of said first cyclone and a bottom, said first internal duct being connected via the diffuser to said first container;

a swirling device housed in said first internal duct;

a capturing ring housed in said first internal duct, downstream of said swirling device, relative to the air flow entering said first internal duct from said top, so as to capture a peripheral fraction of the air flow and allow the remaining fraction to flow down through said ring, said capturing ring forming together with said diffuser an interspace for the passage of said peripheral flow fraction;

a second container for collecting particles;

a second tangential cyclone communicating with said interspace so as to receive said peripheral fraction of flow, said second cyclone having a bottom extending into the second container for collecting particles; and a second duct, axially aligned with said first internal duct and extending inside said second container, in communication with said capturing ring and said second cyclone so as to receive said remaining fraction of flow through said ring and said peripheral flow fraction from said second cyclone and exhaust both said fractions.

2. Vacuum cleaner according to claim 1, in which said capturing ring is provided with helical ribs so as to introduce said peripheral fraction of flow tangentially into said second cyclone.

3. Vacuum cleaner according to claim 1, in which said capturing ring forms an extractor nozzle for introducing said remaining fraction of flow into said second duct and sucking said peripheral fraction of flow out of said second cyclone.

4. Vacuum cleaner according to claim 1, in which said capturing ring is mounted axially slidably in said first duct and provided with support means for a cap sealing a particle-collecting capsule housed in said second container, said vacuum cleaner comprising operating means for axially moving said capturing ring and thus closing said capsule with said cap.

5. Vacuum cleaner according to claim 1, in which said second container is formed inside said first container by an annular element integral with said diffuser and extractable from said first container.

6. Vacuum cleaner according to claim 5, in which said second container is formed inside said first container by an annular element integral with the base of said first container.

7. Vacuum cleaner according to claim 1, in which said second container is removably connected to said first container and said second duct is integral with said second container and connected to a base thereof.

8. Dust-containing capsule, for a vacuum cleaner according to claim 4, wherein a container generally in the form of a conical toroid is provided with two lips for connection with an annular cap for hermetically sealing said container.

9. Dust-containing bag, for a vacuum cleaner according to claim 5, in which an axial tube having ends is comprised extending inside said bag and open at the tube's ends so as to be fitted onto said second duct, without closing the duct when said bag is housed inside said first container.

* * * * *

UNITED STATES PATENT AND TRADEMARK OFFICE

CERTIFICATE OF CORRECTION

PATENT NO. : 6,083,292
DATED : July 4, 2000
INVENTOR(S) : S. Fumagalli

It is certified that error appears in the above-identified patent and that said Letters Patent is hereby corrected as shown below:

Title page,
Item [73], Assignee, correct from "CANOY S.p.A." to -- CANDY S.p.A. --

Signed and Sealed this

Tenth Day of May, 2005

JON W. DUDAS
*Director of the United States Patent and Trademark Office*